US006533262B1

(12) United States Patent
Yagihashi et al.

(10) Patent No.: US 6,533,262 B1
(45) Date of Patent: Mar. 18, 2003

(54) SYSTEM FOR FEEDING A CONTINUOUS MEDIUM INCLUDING MULTI-PLY MEDIA TO A PROCESSING STATION WITH SELECTABLE REDUCTION IN JAMMING, WRINKLING, OR PEALING OF THE MEDIA SURFACE

(75) Inventors: Atsuo Yagihashi, Fujisawa (JP); Kazuyoshi Yoshida, Yokohama (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/239,915

(22) Filed: Jan. 29, 1999

(30) Foreign Application Priority Data

Jan. 30, 1998 (JP) ..... 10-019117

(51) Int. Cl.[7] ..... B65H 3/44
(52) U.S. Cl. ..... 271/9.1; 226/74; 226/86
(58) Field of Search ..... 271/9.1; 226/74, 226/86

(56) References Cited

U.S. PATENT DOCUMENTS 4,054,235 A * 10/1977 Witcher ..... 226/200
5,152,514 A * 10/1992 Meetze ..... 271/3.01

FOREIGN PATENT DOCUMENTS

| | | | |
|---|---|---|---|
| JP | 58-60463 | 4/1983 | |
| JP | 1-242276 | * 9/1989 | ..... B41J/15/04 |
| JP | 03-62050 | 6/1991 | |
| JP | 097309 | 4/1993 | |
| JP | 169748 | 7/1993 | |
| JP | 6-246994 | 6/1994 | |

* cited by examiner

*Primary Examiner*—Donald P. Walsh
*Assistant Examiner*—Kenneth W Bower
(74) *Attorney, Agent, or Firm*—R. Bruce Brodie

(57) ABSTRACT

An apparatus for reducing friction, tearing, or wrinkling of the surface of a single-ply or multiple-ply continuous medium being fed to a processing station by either sprocket engagement of an edge-perforated medium or pinch roller pressure engagement of the medium as the medium moves in a vertically-oriented path, said reduction being effectuated through selectively altering the contact path length of guides supporting the medium in a direction reducing any friction forces.

13 Claims, 8 Drawing Sheets

(A) PROPER FORM POSITION (B) IMPROPER FORM POSITION

SYSTEM FOR FEEDING A CONTINUOUS MEDIUM INCLUDING MULTI-PLY MEDIA TO A PROCESSING STATION WITH SELECTABLE REDUCTION IN JAMMING, WRINKLING, OR PEALING OF THE MEDIA SURFACE

FIELD OF THE INVENTION

This invention relates to printers being fed continuous form media, and more particularly to printers having media drive mechanisms or paths exhibiting variable friction and tension effects on the media, thereby inducing jams of the printer feed or traction mechanism, or wrinkled or pealed surfaces of the media or the like.

DESCRIPTION OF RELATED ART

A printer may be defined as an output unit that produces a hardcopy record of data mainly in the form of a sequence of discrete graphic characters that belong to one or more predetermined character sets. A printer may also be defined as a dual-path transducing system for mapping coded information on an alterable, permanent, visual medium of expression. A first path converts the information into a pattern of transducer actions for one-to-one alteration of the medium. A second path transports the medium to and provides a stable environment for the transducer to interact with and effectuate the permanent alterations or markings of the medium.

The second printer definition lends itself to emphasizing selective classification aspects of printers. For example, printers are classified according to whether the transducer alters the medium by impact or nonimpact means (first path) and whether the medium is discretely or continuously fed (second path). Indeed, for discretely fed printers, the medium is usually paper supplied to the printhead and platen a single sheet at a time. However, for continuously fed printers, the medium is usually a continuous length of a single-or multiple-ply, fan-folded paper with both edges punched for tractor feeding and with perforation between pages. Before printing, the forms are folded in a stacked arrangement with the folds along the perforation. The holes punched along both edges for tractor feeding are termed "carrier holes". Significantly, in continuous form printers, the "tractor" is the mechanism that controls movement of the continuous form paper by means of engaging the carrier holes with sprockets or the like.

There are many examples of continuous form printers such as the IBM 5417 and the IBM 5427. In continuous fed printers, the fan-folded forms are drawn either in straight form feed paths or curved form feed paths. These feed paths define the movement of the paper from its fan-folded position at one horizontal level to an unfolded extended position in the vertical direction at a higher level. In straight form feed paths, the tractor causes paper jams either by tearing apertures on the edges of the forms or by causing the pins to rotate without engaging the apertures. Since straight form feed paths lack any insertion guides, it is difficult for the operator to place the paper in such slit feeds to the tractor. In contrast, curved form feed guides assist the operator in feeding paper to the slit feeds of the tractor. However, such curved guides also increase the friction path in a vertical direction in the case where the fan-folded forms are each multipart forms of relatively heavy weight. Additionally, where the multipart forms consist of labels adhering to a support sheet, the curved feed paths tend to encourage peeling off of the label from a support sheet or encourage the formation of air pockets between the label and a support sheet. The former can cause a jam by wedging in the slit or tractor portions of the paper path. The latter, while not usually resulting in a jam, nevertheless wrinkles.

There are two prior art references of interest, namely, the Japanese published utility model applications S58-60463 and H6-246994. They both pertain to continuous form printing and are directed to the problem of removable print labels adhering to a substrate. The '60463 reference discloses a method for preventing the peel off of a label from its supporting sheet. This is accomplished by pressing the labels to the supporting shape using a sheet-like guide during feed operations and an auxiliary guide plate for applying force to an upper surface of the label to conform the label to a concave shape. Unfortunately, in the '60463 application, the labels are pressed to the supporting sheet after a layer of air is formed. Similarly, in the '246994 application, the guide plate operates as a guide inside of the printer for switching a feed path between a continuous form feed path and a discrete sheet feed path. This, too, does not prevent the formation of air bubbles and the subsequent ring claim of the label.

SUMMARY OF THE INVENTION

It is accordingly an object of this invention to devise an apparatus and method to reduce friction and tension effects in the continuous form feeding of printers.

It is a related object that such apparatus and method mitigate such effects, especially on printers continuously form fed over curved form feed paths.

It is yet another object that such apparatus and method mitigate such effects, especially on printers continuously form fed with a continuous form multilayered medium where the print exposed layer of said medium is removably adherent to a substrate or support layer as is the case for substrate-mounted labels.

The foregoing objects are believed satisfied by a system for feeding a continuous medium to a processing station. The system includes a mechanism for moving the medium in a predetermined, vertically-oriented path over a guide toward the station. It further includes a guide mechanism for selectively altering the path length of the medium in relation to the guide in a direction toward minimizing the friction resistance between the medium and the guide.

In the system, the continuous medium is selected from the set consisting of a single-ply fan-folded paper, multiple-ply fan-folded paper, and multiple-ply paper with alterable labels adhering to support sheets. Furthermore, the guide mechanism includes an arrangement for selectively positioning the guide in either a first or second position. The first position defines a first path length of predetermined curvature including the guide in contact relation with the medium. The second position defines a straight form frictionless feed path between the medium and the guide. Any intermediary position defines a proportionally reduced friction path. Relatedly, the mechanism includes an arrangement for engaging the medium and urging it toward the processing station. The arrangement is selected from a set consisting of sprockets engaging an edge-perforated medium and a pair of pinch rollers forming a pressure contact engagement with said medium.

The positioning of the guide can be implemented through operator manual intervention or through a motorized and sensor-driven automatic system. Also, the guide can be formed from elastic as well as inelastic materials.

DESCRIPTION OF THE PREFERRED EMBODIMENT

Figure 1:
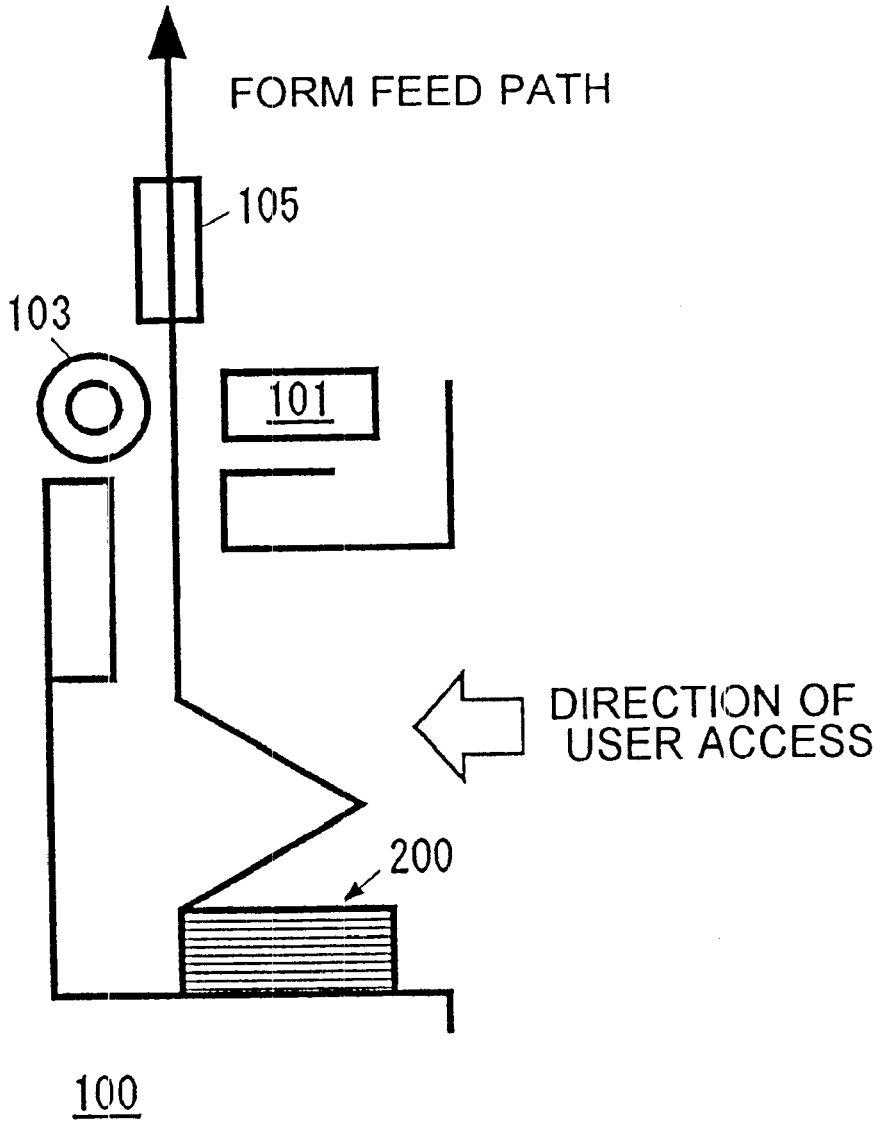
FIG. 1 shows a continuous form printer using a straight form feed path and absent a form insertion guide.

Continuous form-fed printers may be classified into two types according to whether or not they possess an insertion guide. Both types of printers successively feed the continuous form from a position below a printhead to a position above the printhead by a tractor to print the continuous form. The tractor engages the medium with pins or sprockets inserted into side perforations or holes along each side or edge of the paper or medium. Those printers which do not include a form insertion guide do include a straight form feed path. This is illustrated in FIG. 1. Those printers which do include the form insertion guide 110 also include a curved form feed path. This is shown in FIG. 2.

Referring now to FIG. 1, there is shown a continuous form printer using a straight form feed path and absent a form insertion guide. As mentioned, an insertion guide is a transport mechanism for the medium as it moves through the paper path to allow it to maintain a continuity and tension with the tractor pulling it past the printhead and platen or the like.

In the continuous form printer 100, the form feed path is a straight and frictional force between the form insertion guide 110 and the continuous form 200 is not generated. Thus, the occurrence of a paper jam is relatively low. Parenthetically, paper jams are caused either by pins on the tractor 105 tear apertures on both edges of the continuous form 200 or by the pins on the tractor rotating without engaging the apertures on the form 200. However, the absence of an insertion guide requires that an operator carefully insert the medium into the slit that feeds into the tractor 105.

Figure 2:
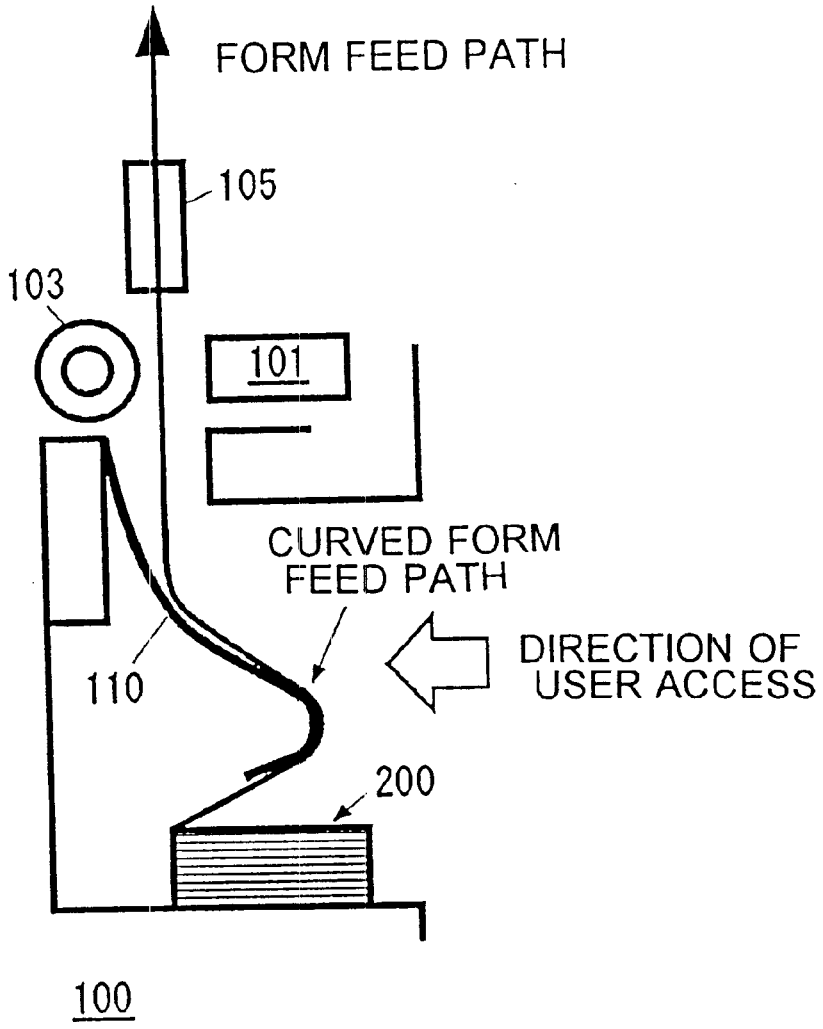
FIG. 2 depicts the continuous form printer of FIG. 1 but modified to include a form insertion guide and a curved form feed path.

Referring now to FIG. 2, there is shown the continuous form printer of FIG. 1 but modified to include a form insertion guide 110 and a curved form feed path. In this printer, the operator can set the continuous form 200 by slidably moving the top end or edge of the continuous form 200 on the form insertion guide 110 toward the feeding slit, whereby the operability for setting the continuous form is excellent. The continuous form 200, however, moves along a curved path of the form insertion guide 110. This increases the frictional resistance force. If the force is larger than that generated in the straight form feed path, then the likelihood of a jam increases. Indeed, where the continuous medium consists of a multipart form of a relatively heavy weight, the frictional force to the form insertion guide 110 increases due to an increase of a drag force in a vertical direction. Furthermore, the likelihood that the tractor 105 will engage the multilayer form 200 decreases due to the increase of the form's thickness. These factors combine to enhance the probability of occurrence of a paper jam.

Figure 3:
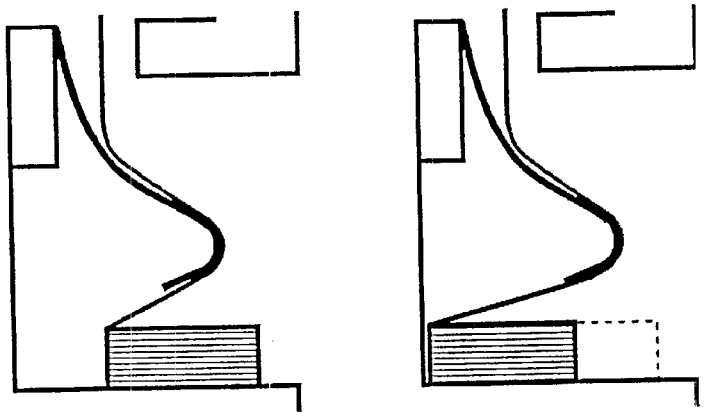
FIG. 3 illustrates the appropriate and inappropriate supply rest positions of the fan-folded continuous forms in relation to the form feed path.

Referring now to FIG. 3, there is shown the appropriate and inappropriate supply rest positions of the fan-folded continuous forms in relation to the form feed path. The frictional force generated between the continuous form 200 and the form insertion guide 110 increases in the case that the continuous form is set in an improper form position. This is one cause of paper jams.

Figure 4:
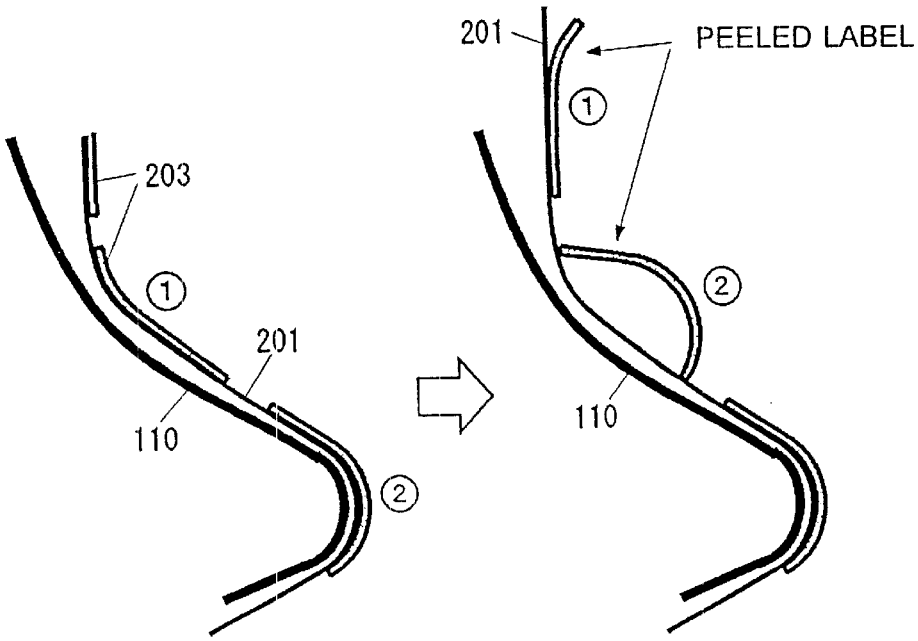
FIG. 4 sets forth the stress conditions that labels (removably adherent print layers) bear in relation to their support layer in the movement of a continuous form medium over a curved guide in a curved form feed path.

Referring now to FIG. 4, there is shown the stress conditions that labels (removably adherent print layers) bear in relation to their support layer in the movement of a continuous form medium over a curved guide in a curved form feed path. When a label form is printed, the curved portion of the form insertion guide 110 deforms the label. At this point, the label tends to peel off, increasing the paper jam likelihood in comparison with that of the straight form path. Another factor is that a layer of air forms between the label 203 and a supporting sheet 201. This results in the label 203 wrinkling. Shifting of the position of the label 203 on the supporting sheet 201 can also cause wrinkling. This results in a degradation of print quality of the outputted label.

Figure 5:
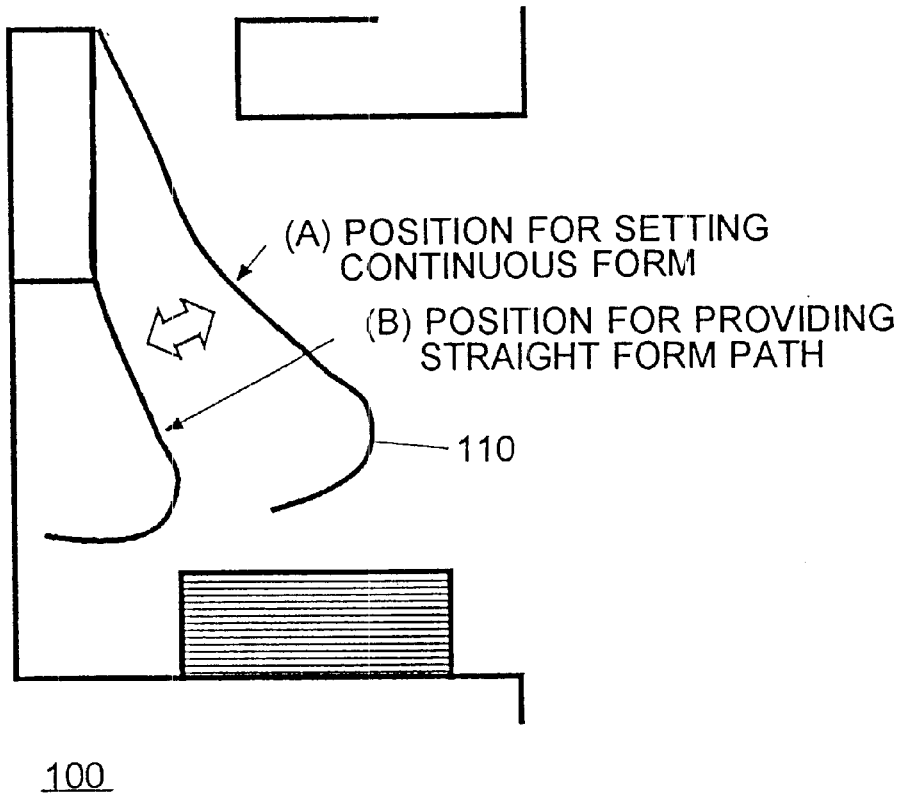
FIG. 5 shows a movable form insertion guide in the continuous form printer of the present invention.
Figure 6:
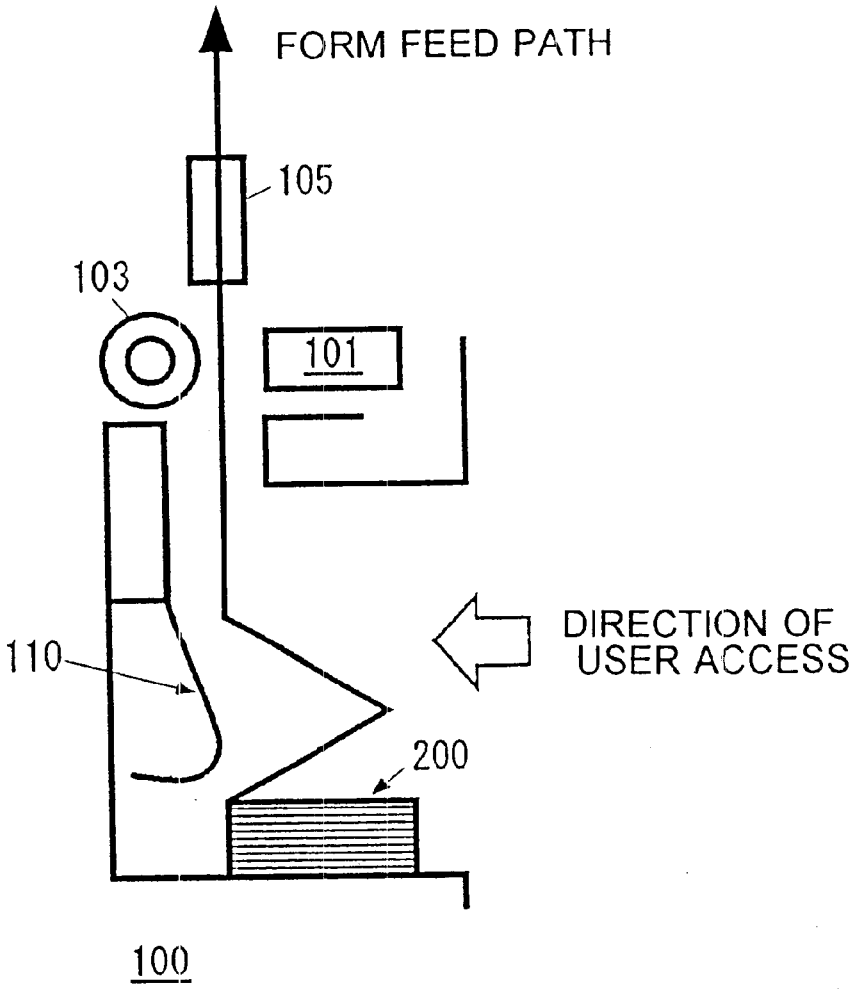
FIG. 6 depicts the straight form feed path when the guide is in the other selectable position.

Referring now to FIG. 5, there is shown a movable form insertion guide in the continuous form printer of the present invention. The form insertion guide 110 of the printer 100 can move between positions A and B. In position A, the medium is easy to insert into the tractor, while in position B a continuous medium is supplied in the straight form feed path absent paper jamming. The latter is illustrated by reference to FIG. 6. When the continuous form is set in the printer, the form insertion guide 110 is moved to position A. Next, the form insertion guide 110 is moved to position B. This is illustrated in FIGS. 5 and 6. Significantly, the frictional force is not generated between the continuous form 200 and the form insertion guide 110. However, if the guide assumes an intermediate position, then the frictional force is reduced to a sufficiently smaller value from that generated at position A between the continuous form 200 and the form insertion guide 110 even if the continuous form 200 touches the form insertion guide 110.

Figure 7:
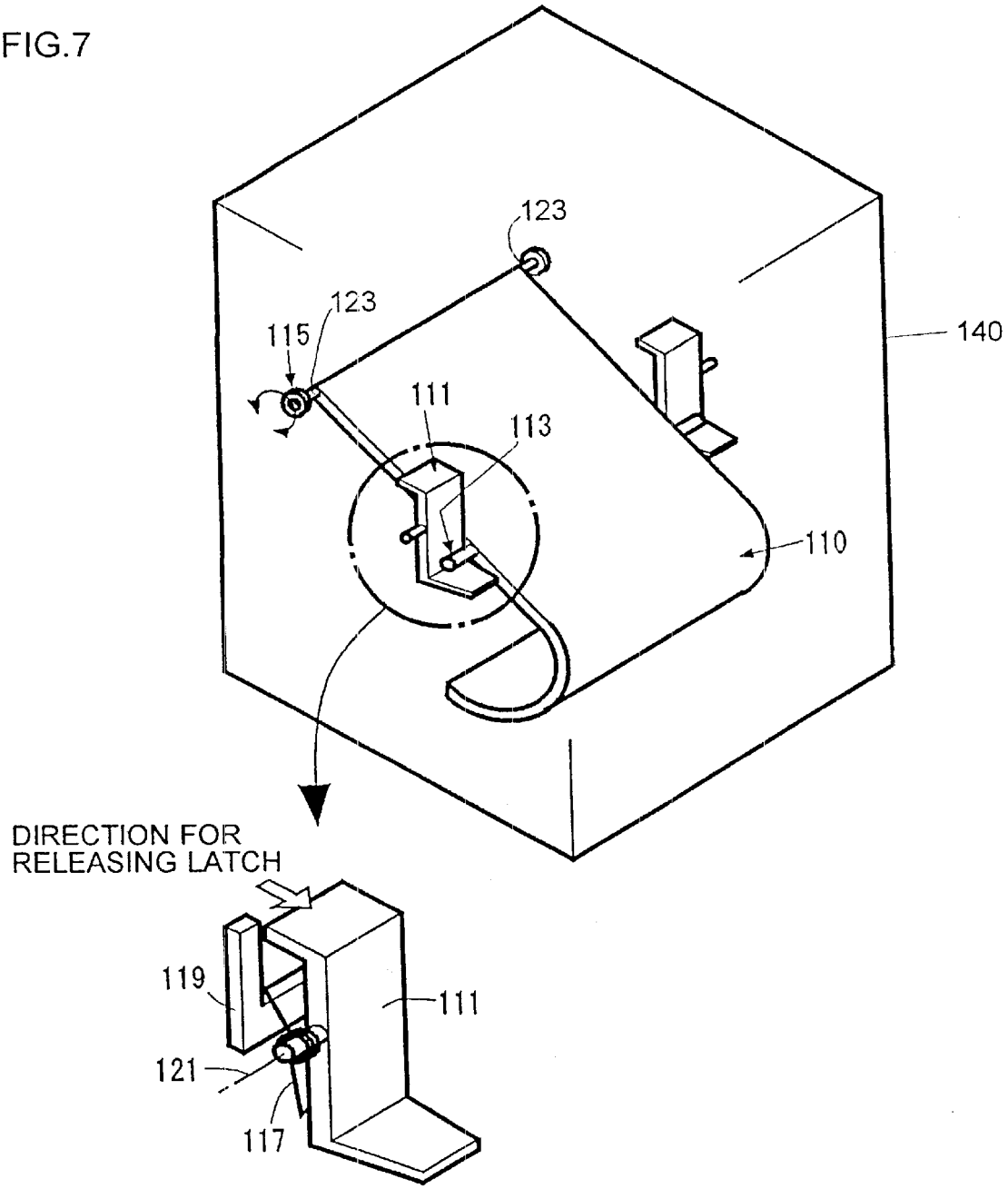
FIG. 7 illustrates the embodiment of the mechanism for moving the position of the form insertion guide, especially the releasing latch and the extended members.

Referring now to FIG. 7, there is shown the embodiment of the mechanism for moving the position of the form insertion guide, especially the releasing latch and the extended members.

In this embodiment, shafts 123 are attached to the upper end of the form insertion guide 110 and the shaft 123. The shaft is supported by bearings 115. This enables the form insertion guide 110 to rotate around the shaft 123 either in a clockwise direction or a counterclockwise direction. Extended members 113 engage a latch 111 and are attached to the form insertion guide 110. The latch rotating shafts 121 hold the extended members 113. These are pivotally mounted to a box frame 140 of the printer. Thus, the latch 111 can rotate around the latch rotating shaft 121. A coil spring 117 is mounted on the latch rotating shaft 121. One end of the coil spring 117 engages the latch 111. The other end of the coil spring 117 engages a stopper 119 fixed on the box frame 140. This biases the latch 111 in the counterclockwise direction.

When the form insertion guide 110 is moved from position B to position A, the form insertion guide 110 is rotated upwardly in the counterclockwise direction. As the form insertion guide 110 is rotated, the extended members 113 engage with the bottom surface of a horizontal member of the latch 111. As the form insertion guide 110 is further moved upwardly, the latch 111 is rotated around the latch-rotating shaft 121 in the counterclockwise direction. Finally, the extended members 113 disengage from the bottom surface of the horizontal member of the latch 111. Since a rotating radius of the latch 111 around the latch rotating shaft 121 differs from a rotating radius of the extended members 113 around the shafts 123, the latch 111 is rotated in the clockwise direction. This means that the extended members 113 are received by an upper surface of the horizontal member of the latch 111, and the form insertion guide 110 is stopped at position A.

Significantly, the operator can move the form insertion guide 110 to position B. This provides the straight form feed path. Such a path is defined by pulling an upper portion of the latch 111 in a direction shown by an arrow in FIG. 7 to disengage the extended members 113 from the latch 111 after setting the continuous form. It is possible to use a mechanism for automatically moving the form insertion guide 110. This is done in response to an open/close action of a front door 143 or a top cover. More particularly, it is possible to use a mechanism for automatically moving the form insertion guide 110 to the forward position in response to the opening of the front door 143 or the top cover. It is a mechanism for fixing the pivoted form insertion guide 110 or a mechanism for fixing the shafts 123 of the form insertion guides 110. This is exemplified by a sickle-like stopper, a hook, a sidable stopper, a magnet, a gear which is rotatable in one direction by a stopper, etc. which can be used in place of the latch mechanism 111.

The weight of the form insertion guide 110 causes it to move to position B in the embodiment shown in FIG. 7. In this case, when a vibration caused by an earthquake or a shock due to a movement of the continuous form printer 110 during the print operation is applied to the continuous form printer 110 during the print operation, the form insertion guide 110 may swing. Therefore, the form insertion guide 110 may possibly contact the continuous form 200 being fed. To solve the problem, the form insertion guide 110 is biased to position A. This is attained by using an elastic force of an elastic material such as a spring or an elastic resin. This is fixed at position B by the fixing member, such as the latch, the magnet, etc. as described above. In this case, position A is a home position of the form insertion guide 110.

Figure 8:
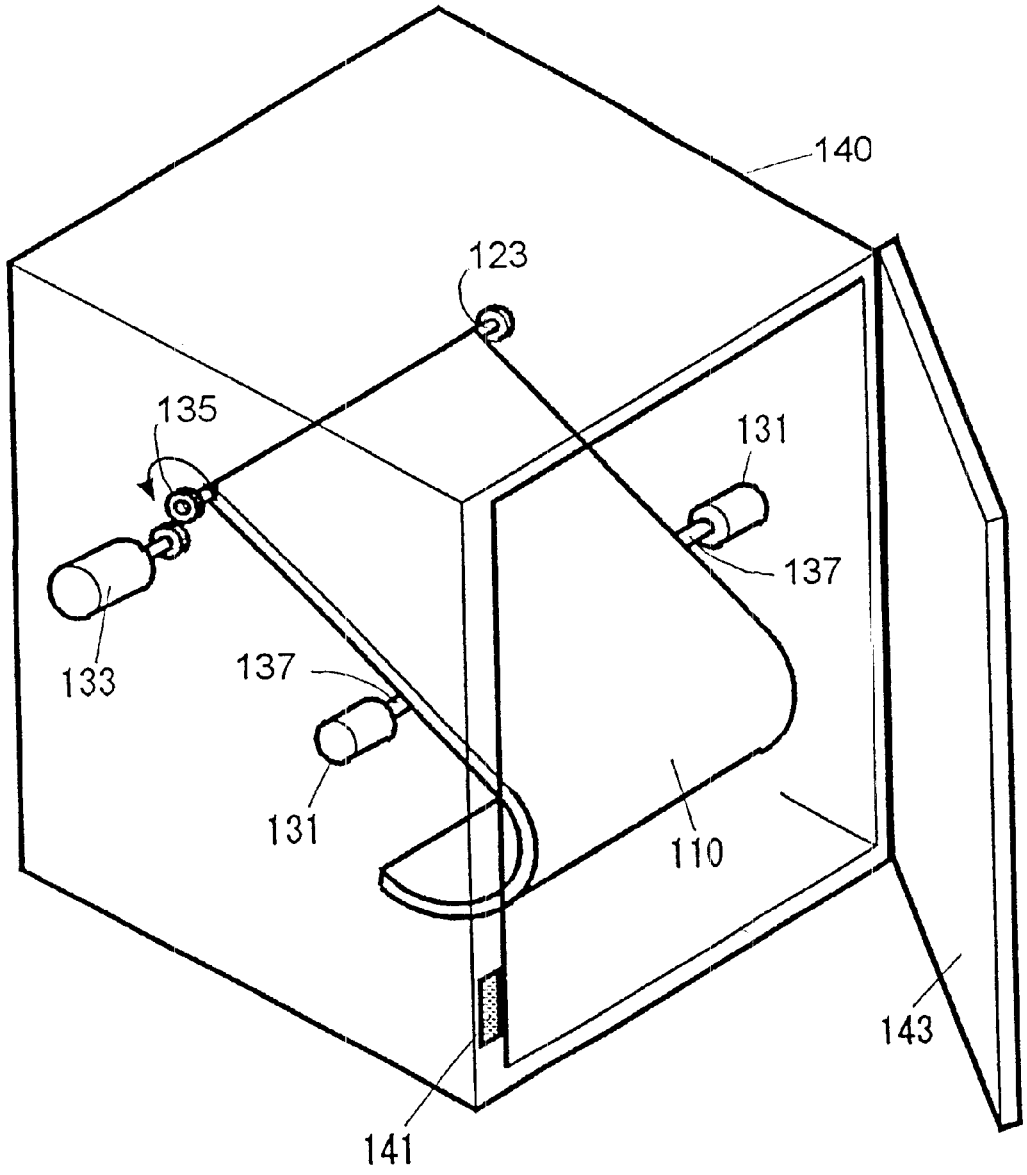
FIG. 8 sets forth a motorized version for moving the form insertion guide according to the invention.

Referring now to FIG. 8, there is shown a motorized version for moving the form insertion guide according to the invention. In this figure, a motor 133 translates the form insertion guide 110. A door sensor 141 for sensing the opening of the front door 143 is attached to the box frame 140. Also, a gear 135 rotated by the motor 133 is attached to the shaft 123 of the form insertion guide 110. In this case, the form insertion guide 110 is rotated around the shaft 123 by the motor 133. Further, solenoids 131 are provided to prevent the form insertion guide 110 from being moved downwardly at the change of the continuous form. When the solenoids 131 are activated, stoppers 137 engaging with the form insertion guide 110 are retracted. When the front door 143 is opened, the solenoids 131 are activated to retract the stoppers 137 and the motor 133 is activated to move the form insertion guide 110 to position A, causing the operator to easily insert the continuous form. When the completion of the movement of the form insertion 110 is detected by counting the number of steps of the motor 131, the solenoids 131 are deactivated so that the stoppers 137 are extended to support the form insertion guide 110. When the front door 143 is closed after the completion of the set of the continuous form, the door sensor 141 detects the closing of the front door 143. The solenoids 131 are again activated to retract the stoppers 137, and the motor 133 is activated to move the form insertion guide 110 to position B providing the straight form feed path.

Figure 9:
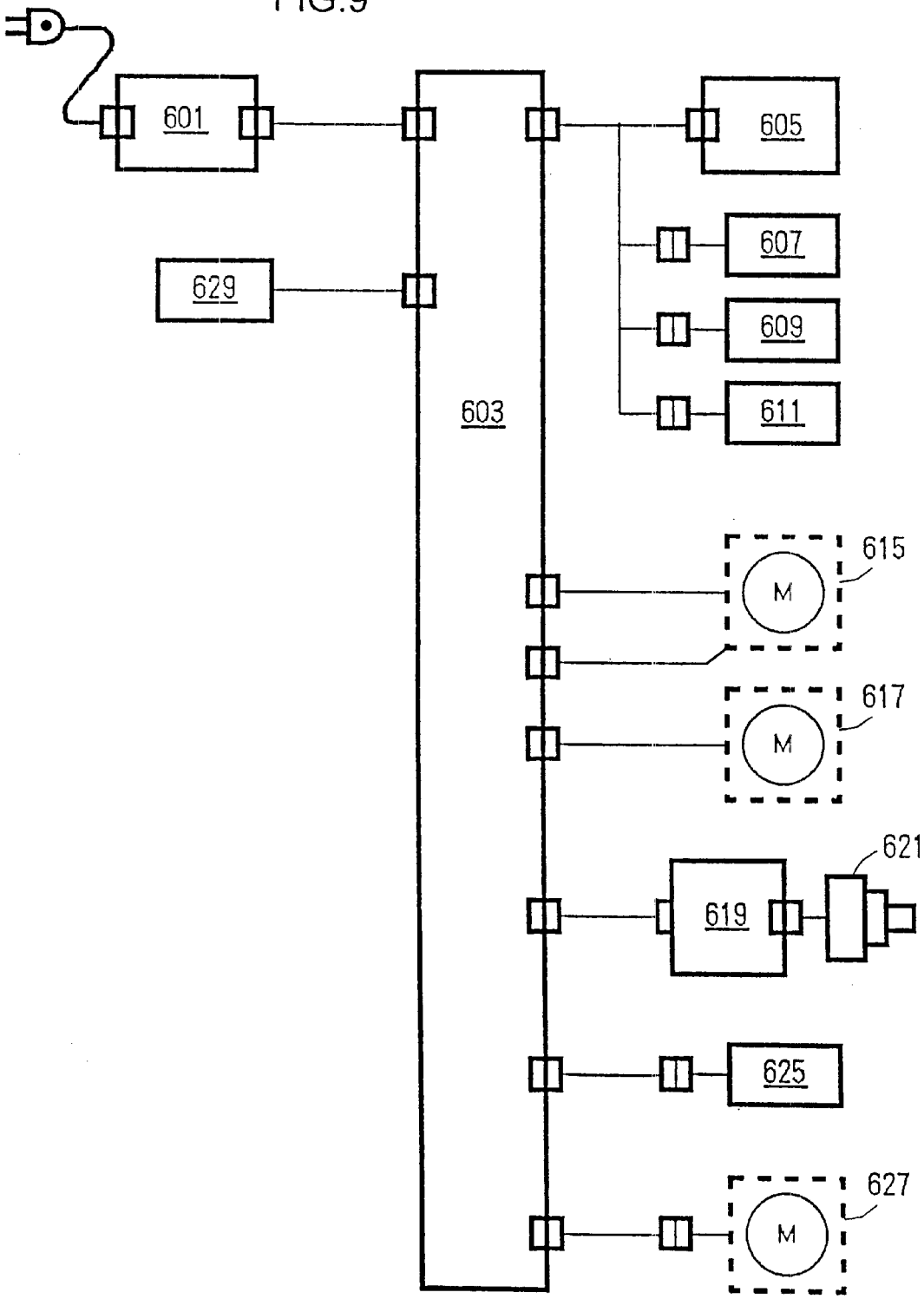
FIG. 9 shows the electrical power and distribution arrangement for energizing the apparatus for moving the form insertion guide by the motor per the invention.

Referring now to FIG. 9, there is shown an electrical power distribution arrangement of the printer 100 for moving the form insertion guide 110 by the motor 133, A reference number 601 indicates a power supply for supplying power to the printer 100. A reference number 603 indicates a main card for connecting various sensors, motors, and a control means 629. In this embodiment, the control means 629 is a microprocessor unit on the main card 603, and includes MPU, ROM, RAM, etc. The control means 629 can be replaced by a computer connected to the printer. The control means 629 receives signals from the various sensors 607, 609 to control the various motors 615, 617, and 627 and the various cards 605 and 619 based upon a control program in the microprocessor unit.

A reference number SOS indicates an operator panel card that receives inputs from the user and controls the display operation of a display panel. Reference numbers 607, 609, and 611 are the various sensors. The sensor 607 is an insertion slit sensor for sensing the insertion of the top end or edge of the continuous form 200. The sensor 609 is the sensor for detecting the opening of the front door 143. Lastly, the sensor 611 is a jam sensor for detecting the jam of the continuous form. The reference numbers 615, 617, and 627 indicate motors. The motor 615 is a carrier motor for moving the printhead 621, the motor 617 is a feed motor for rotating feed rollers, and the motor 627 is the motor for rotating the form insertion guide 110. The printhead 621 is connected to the main card 603 through a connector card 619.

While the invention has been described with respect to an illustrative embodiment thereof, it will be understood that various changes may be made in the method and means herein described without departing from the scope and teaching of the invention. Accordingly, the described embodiment is to be considered merely exemplary and the invention is not to be limited except as specified in the attached claims.

What is claimed is:

1. A system for feeding a continuous medium to a processing station comprising:

a mechanism for moving the medium in a predetermined, vertically-oriented path over a guide toward the station; and a guide mechanism for selectively altering the path length of the medium in relation to the guide in a direction toward minimizing the friction resistance between the medium and the guide.

2. The system according to claim 1, wherein the continuous medium is selected from the set consisting of a single-ply fan-folded paper, multiple-ply fan-folded paper, and multiple-ply paper with alterable labels adhering to support sheets.

3. The system according to claim 1, wherein any composition of forces operative upon the medium as it moves through its vertically-oriented path includes a gravitational component.

4. The system according to claim 1, wherein the guide mechanism includes an arrangement for selectively positioning said guide in either a first or second position, said first position defining a first path length of predetermined curvature including the guide in contact relation with the medium, said second position defining a straight form frictionless feed path between the medium and the guide, any intermediary position defining a proportionally reduced friction path.

5. The system according to claim 1, wherein the mechanism includes an arrangement for engaging the medium and urging it toward the processing station, said arrangement being selected from a set consisting of sprockets engaging an edge-perforated medium and a pair of pinch rollers forming a pressure contact engagement with said medium.

6. A multiple-path transducing system for mapping coded information onto an alterable, permanent, visual medium comprising:

(a) a first path including logic for converting the coded information into discrete graphic characters belonging to one or more predetermined character sets and for imaging the graphic characters upon the medium; and (b) a second path including a mechanism for moving the medium in a continuous form in a predetermined, vertically-oriented locus over a guide toward the imaging portion of the first path, said second path including a guide mechanism for selectively altering the path length of the medium in a direction toward minimizing the friction resistance between the medium and the guide.

7. The system according to claim 6, wherein the guide mechanism includes an arrangement for selectively positioning said guide in either a first or second position, said first position defining a first path length of predetermined curvature including the guide in contact relation with the medium, said second position defining a straight form frictionless feed path between the medium and the guide, any intermediary position defining a proportionally reduced friction path.

8. The system according to claim 7, wherein said guide mechanism includes:

(a) a latch for securing said guide in said second position; and (b) bias means selected from a set consisting of a spring and a guide formed from an elastic material, said bias means being configured so as to urge the guide toward the first position upon release of the latch.

9. The system according to claim 6, wherein said medium is a continuous form medium selected from the set consisting of a single-ply fan-folded paper, multiple-ply fan-folded paper, and multiple-ply paper with alterable labels adhering to support sheets.

10. The system according to claim 6, wherein the graphic characters are characters selected from the set consisting of typographic characters, characters defining conductive paths on the medium, and characters defining optically permeable paths on the medium.

11. An apparatus for feeding a continuous medium toward a processing station comprising:

(a) a mechanism for moving the medium in a predetermined, vertically-oriented path over a guide toward the station, said mechanism including a first arrangement for engaging the medium and urging it toward the processing station, said arrangement being selected from a set consisting of sprockets engaging an edge-perforated medium and a pair of pinch rollers forming a pressure contact engagement with said medium; and (b) a guide mechanism for selectively altering the path length of the medium in relation to the guide in a direction toward minimizing the friction or other resistance between the medium and the guide, said guide mechanism including a second arrangement for selectively positioning said guide in either a first or second position, said first position defining a first path length of predetermined curvature including the guide in contact relation with the medium, said second position defining a straight form frictionless feed path between the medium and the guide, any intermediary position defining a proportionally reduced friction path.

12. The apparatus according to claim 11, wherein any composition of forces operative upon the medium as it moves through its vertically-oriented path includes a gravitational component.

13. The apparatus according to claim 11, wherein said apparatus includes:

(a) a latch for securing said guide in said second position; and (b) bias means selected from a set consisting of a spring and a guide formed from an elastic material, said bias means being configured so as to urge the guide toward the first position upon release of the latch.

* * * * *